United States Patent [19]

Kendall

[11] 4,362,965

[45] Dec. 7, 1982

[54] COMPOSITE/LAMINATED WINDOW FOR ELECTRON-BEAM GUNS

[75] Inventor: John S. Kendall, Lebanon, Conn.

[73] Assignee: The United States of America as represented by the Secretary of the Army, Washington, D.C.

[21] Appl. No.: 220,321

[22] Filed: Dec. 29, 1980

[51] Int. Cl.[3] ..... H01J 33/00

[52] U.S. Cl. ..... 313/420

[58] Field of Search ..... 313/420

[56] References Cited

U.S. PATENT DOCUMENTS

| | | | |
|---|---|---|---|
| 3,041,453 | 6/1962 | Daly | 313/420 X |
| 3,418,155 | 12/1968 | Colvin et al. | 313/420 X |
| 3,469,139 | 9/1969 | Colvin | 313/420 |
| 3,780,334 | 12/1973 | Leboutet | 313/420 X |
| 3,798,570 | 3/1974 | Hagood et al. | 331/94.5 |
| 4,104,647 | 8/1978 | Sheldon | 313/420 X |

*Primary Examiner*—Robert Segal

*Attorney, Agent, or Firm*—Nathan Edelberg; Robert P. Gibson; Jack W. Voight

[57] ABSTRACT

A composite/laminated window for electron-beam guns is comprised of a first material of a polyester film, a second material of a low-Z metal selected from the low-Z metals consisting of aluminum, beryllium, and titanium in intimate contact with the polyester film, and a plurality of fluid cooled, spaced apart foil support members for supporting and cooling the composite window. The metal layer provides for heat transmission of the heat deposited in the metal layer and the polyester film by the electron beam. The polyester film which has 3 to 4 times the strength of the metal layer provides the strength and transmission required for a window operating in a vacuum on the electron gun side and a high pressure on the laser cavity side when the electron beam gun is employed as the source of electrons to produce ionization in the laser cavity.

1 Claim, 3 Drawing Figures

COMPOSITE/LAMINATED WINDOW FOR ELECTRON-BEAM GUNS

DEDICATORY CLAUSE

The invention described herein was made in the course of or under a contract or subcontract thereunder with the Government; therefore, the invention described herein may be manufactured, used, and licensed by or for the Government for governmental purposes without the payment to me of any royalties thereon.

BACKGROUND OF THE INVENTION

High-power, high-energy electron beam guns require special window materials for their operation. For many high-pressure electron-gun (e-gun) applications the maximum pressure differential that the electron beam window can withstand limits its range of applicability. Many high strength materials which might be used for electron beam windows suffer from either one of two disadvantages (1) they are high-Z foils and thus have large electron absorption cross sections or (2) they contain elements as alloy constituents which over time cause cathode degradation.

Of particular interest is the widespread use of a high-power, high-energy electron beam gun in high-power electric discharge lasers. The windows for this use have attracted the interests relating to improvements needed.

The use of electron beam ionization in high-power electric discharge lasers is currently widespread but improvements to electron beam windows are needed. This method of ionization is an attractive means for producing large-volume ionization in molecular gases. Present day electron beam sustained lasers require electron beams with uniform current densities over large beam areas. Generally, these lasers operate in either pulsed or continuous modes with peak pressures in the laser channel of several atmospheres. The electron beam gun which serves as the source of electrons to produce ionization in the laser channel operates in a vacuum environment. Thus, a vacuum interface is required to isolate the gun environment from the higher-pressure laser cavity environment. This interface, the electron beam window, is generally comprised of a thin foil material having high electron transmission over the useful energy range of the gun. Poor reliability of these windows has been one of the problems which has limited the usefulness of electron beam guns in laser applications. In wide-area electron beam guns the foil window bears on a foil support structure which provides both mechanical support and cooling for the window.

There are several factors which make the design and fabrication of a reliable electron beam window for laser applications difficult. Cooling requirements for high current levels are stringent. It is desired to operate the guns at conditions which result in volumetric heat deposition rates in the window material of 10 to 50 kw/cm$^3$ of foil material. The window must be thin and must be made of low atomic number material to minimize absorption of electrons. The window must be vacuum tight and capable of withstanding pressure differentials as high as 10 atm in some systems. The window must also be able to withstand transient stress loading arising from acoustic pulses produced in the laser channel during short pulse operation.

The investigations of the needed requirement have provided information necessary to develop a reliable, 15-cm-wide by 100-cm-long, cooled electron beam window for pulsed or continuous operation. The basic design point conditions are: (1) maximum mean laser operating pressure of 2 atm with a pulsed pressure of up to 4 atm; (2) in pulsed operation, maximum current density transmitted through the window of 10 mA/cm$^2$ throughout the range of beam energies between 100 and 200 keV; (3) pulse repetition frequency of 100 Hz; or if possible up to 1000 Hz; and (4) in continuous operation, maximum current density transmission of 0.3 mA/cm$^2$, and if possible up to 1.5 mA/cm$^2$ for short durations. At the time this program was initiated, attainment of these continuous current densities was beyond the state of the art of available electron beam hardware.

The investigations were centered around three parts: (1) evaluation of foil window material characteristics, (2) evaluation of various window support configurations and geometries to provide both support and cooling of the thin foil window, and (3) small-scale testing of promising support configurations and foil materials in continuous and pulsed operation, with and without heat addition to the foil.

Other investigations considered beryllium foil windows because of its low atomic number. Disadvantages for use of the beryllium foil included high cost and poor availability. For example, it is estimated that a 15 cm wide by 100 cm long beryllium foil window, 25 $\mu$m thick, would have a material cost of approximately $5300, whereas for aluminum only approximately 2 cents worth of commercial material is required.

Carbon was also considered as a candidate foil material for electron beam windows since the technology for producing thin carbon tape does exist for producing a suitable foil of small size. Carbon is low atomic number (6) and its high-temperature properties offset somewhat its low thermal conductivity and thermal diffusivity. The problem of fabricating sufficiently large samples of carbon foil having the ductility required will require additional research.

An electron beam window constructed of a composite was considered to have potential merit; therefore, additional research was devoted to this approach for developing an electron beam window that would be particularly attractive for use in combination with a high-power, high-energy electron beam gun.

The advantages of employing a window constructed of a composite material would be to select and utilize the characteristics of each material that will accrue the desired benefits for an improved electron beam window.

Therefore, an object of this invention is to provide a composite window for use with a high-power, high-energy electron beam gun which will permit a wider range of use for the high-power, high-energy electron beam gun.

A further object of this invention is to provide a window for use with a high-power, high-energy electron beam gun wherein the window is constructed of composite material with one of the materials having good heat transfer characteristics for removing a greater portion of the energy deposited in the material by the electron beam and the other material having a high strength and suitable conductance properties for conducting additional heat energy for dissipation by the material having the good heat transfer characteristics.

SUMMARY OF THE INVENTION

The composite/laminated window of this invention for electron-beam guns is comprised of two materials: (1) a first material of a polyester film (Mylar or Kapton) for supporting a low-Z metal layer, and also having a low-Z (of about 4.5), but a higher-strength than the low-Z metal layer, and (2) a second material in the form of a layer of a low-Z metal selected from the low-Z metals consisting of aluminium, beryllium, and titanium and having a good heat transfer characteristic for removing energy deposited in the low-Z metal layer by the electron beam.

The term Z refers to atomic number. In the case of polyester (Mylar), the effective atomic number computed on an atom-weighted average basis is approximately 4.5, which is evidence that Mylar has good transmission characteristics for electrons in the energy range between 100 keV and 200 keV. Kapton polyester has good electron transmission. At higher temperature operation the Kapton polyester showed better performance.

The calculated electron cross-section for the polyester layer is approximately 0.5 times that of aluminum. However, the strength characteristics of these polyester films are on the order of 3 to 4 times that of pure aluminum. Thus, the window structure is a composite, a layer of low-Z metal on a polyester film which has improved transmission and superior strength. The composite window is comprised of a laminated polyester-metal foil (or alternately, vapor deposited metal on polyester film) and has fluid cooled, spaced apart support members for supporting and cooling the composite window. The energy deposited in the foil material is conducted a distance equal to the spacing of the supporting members which spacing is generally about 0.1 inch. The temperature rise in the foil material is proportional to the square of the support spacing for a given volumetric heat generation rate and foil material.

DESCRIPTION OF THE PREFERRED EMBODIMENT

The electron beam window of this invention, for use with a high-power, high-energy electron beam gun, is constructed of a composite material of a first material of a polyester film (Mylar or Kapton) for supporting a low-Z metal layer, and having a low-Z but a higher-strength than the second material, and a second material of a layer of a material selected from the low-Z metals consisting of aluminum, beryllium and titanium.

The electron beam window composite is supported by cooled foil support members which are typically spaced about 0.1 inch apart. The electron beam is directed toward the metal side of the composite. The energy deposited in the foil or metal layer is conducted to the foil supports through a distance equal to the support spacing. The typical material of construction for the support is beryllium copper which is designed for fluid cooling to remove heat from the composite window. The temperature rise in the foil material is proportional to the square of the support spacing for a given volumetric heat generation rate and foil material. The thermal conductivity of polyester films is small relative to that of the metallic films. However, in the composite design the heat deposited in the polyester is removed by conduction to the aluminum layer. For equal-thickness layers of aluminum and Mylar, approximately two-thirds of the total energy deposited in the foil would be deposited directly in the aluminum layer and the remaining one-third deposited in the Mylar and conducted a distance of 0.0005 inch or less to the aluminum heat sink.

Figure 1:
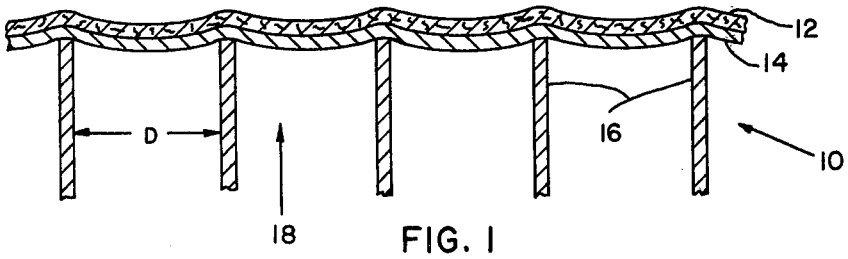
FIG. 1 of the drawing illustrates the structure of an electron beam window having cooled, foil window supports for a composite electron beam window of a low-Z metal on a polyester film constructed in accordance with this invention and for use in combination with an electron beam gun and a laser cavity (not shown).

In further reference to the figures of the drawing, FIG. 1 depicts a composite electron beam window 10 constructed of a composite of a polyester film 12 with a metal layer 14 selected from the low-Z metal consisting of aluminum, beryllium, and titanium which is laminated or vapor deposited to the polyester film. The electron beam window is supported by cooled foil window support members 16 which are spaced apart by a distance D which is typically about 0.1 inch. The direction of the electron beam is illustrated by the arrow 18 which is directed from the low pressure side of the window with a pressure of about zero absolute. The electron beam impinges upon the metal layer which serves as a heat sink. Also, the heat deposited in the polyester film is removed by conduction to the metal layer.

Figure 2:
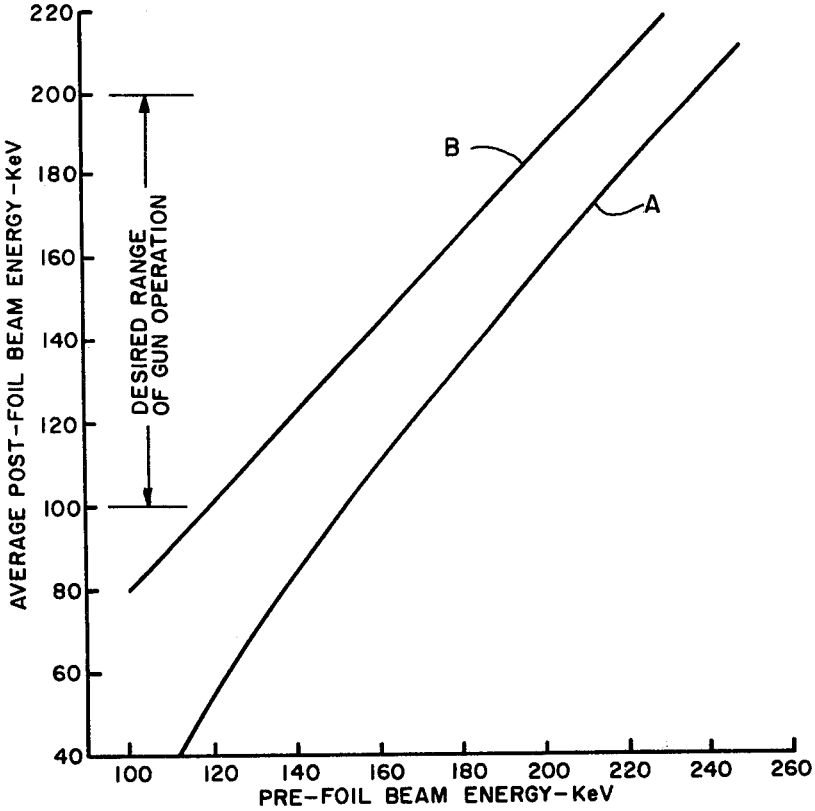
FIGS. 2 and 3 depict calculated energy transmission characteristics for 1 mil thick composite electron beam window and 2 mil thick pure aluminum foil over a range of post-foil beam energies between 100 and 200 keV.
Figure 3:
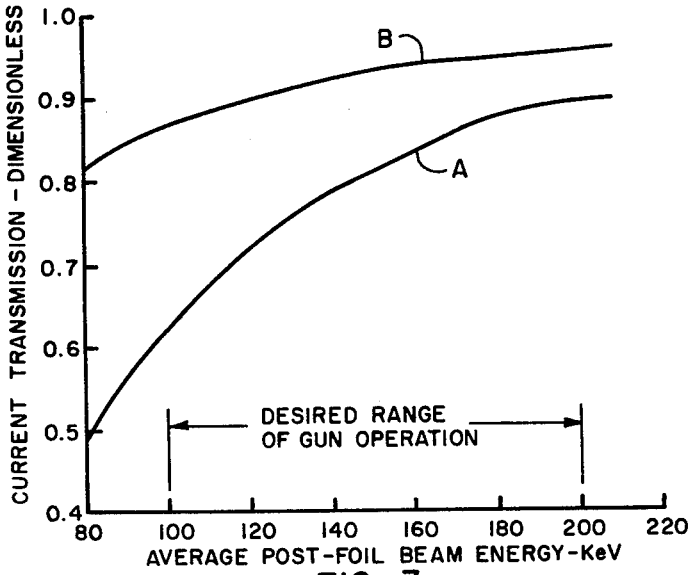

Use of foil materials of this general construction could theoretically reduce the power supply requirements for high-power e-beam guns necessary to produce a given amount of current on the post-foil side of the gun. Results of theoretical foil transmission calculations for 1-mil thick composite foil and a 2-mil thick aluminum foil over a range of post-foil beam energies between 100 and 200 keV are shown in FIGS. 2 and 3. (The tensile strength of the 1-mil composite foil is approximately 2 times that of the 2-mil aluminum.) It can be seen that significant gains in current transmission are achieved through use of composite foils. At 100 keV the transmission rises from 62 percent to approximately 85 percent in going from the aluminum foil to the composite foil. One further advantage which could be obtained by use of Kapton foil with aluminum would be that of high temperature operation. The Kapton polyester showed better performance for higher temperature operation. Kapton has a service temperature of approximately 250° C. The maximum service temperature for the composite of Mylar and aluminum is about 150° C. Both Mylar and Kapton are polyesters produced by Dupont Company.

FIG. 2 is a plotting of the calculated pre-foil beam energy-keV on the abscissa scale against the calculated average post-foil beam energy keV on the ordinate scale. Curve A illustrates the energy transmission through 2-mil aluminum while Curve B illustrates the energy transmission through 1-mil composite window. The desired range of gun operation illustrates the improvement or less energy loss of energy transmission through composite window as compared to pure aluminum window.

FIG. 3 is a plotting of the current transmission characteristics for composite and pure aluminum foils. The calculated average post-foil beam energy in keV is plotted on the abscissa scale against the calculated current transmission (in dimensionless values) which is plotted on the ordinate scale. Curve B illustrates higher current transmission values through a 1-mil thick composite window as compared with curve A which illustrates the current transmission values through a 2-mil thick pure aluminum window at the respective average post-foil beam energy-keV.

The data set forth in Table I below shows key results of time-varying foil loading tests without heat addition. This data illustrates that a composite window (e.g., aluminum/polyester) of less thickness will withstand an equal mean and peak pressure as measured for a greater thickness of aluminum. The improved electron transmission with superior reliability against rupturing indicates the advantage of the composite window over a foil aluminum window. The actual static burst pressure in atmospheres for foil material (aluminum) and Mylar-/aluminum composite is set forth in Table II. This data shows that a thickness reduction of about 50% in the composite only slightly reduces the burst pressure from 10.9 to 8.8 atmospheres as compared to 25 μm aluminum foil. The same thickness of composite increases the burst pressure from 10.9 to 17.7 atmospheres, for a similar comparison between 25 μm aluminum and the composite window.

TABLE I

| Foil Material | Foil Thickness, μm | Mean Pressure, atm | Peak Pressure, atm | Number of Cycles | Post-Test Condition of Foil |
|---|---|---|---|---|---|
| Aluminum | 25 | 3.4 | 6.8 | 1,575[1] | Ruptured |
| Aluminum | 25 | 2.0 | 4.0 | 8,243[1] | Ruptured |
| Aluminum | 25 | 2.0 | 4.0 | 20,383[1] | Ruptured |
| Aluminum | 25 | 2.0 | 4.0 | 101,337[2] | Intact |
| Aluminum | 25 | 2.0 | 4.0 | 1,300,000[2] | Intact |
| Mylar/ Aluminum Composite | 12.7 | 2.0 | 4.0 | 100,116[2] | Intact |
| Mylar/ Aluminum Composite | 25 | 2.0 | 4.0 | 101,765[2] | Intact |
| Titanium | 7 | 2.0 | 4.0 | 78,000[3] | Porous |

Notes:
[1]Rough edges on foil-support identified and removed after test.
[2]Test terminated with foil intact.
[3]Test terminated when small cracks developed in foil.

TABLE II

TEST CONDITIONS AND BURST PRESSURES FOR STATIC FOIL LOADING TESTS

| Test No. | Foil Material | Foil Thickness, μm | Static Burst Pressure, atm |
|---|---|---|---|
| 1. | Aluminum | 25 | 10.9 |
| 2. | Aluminum | 25 | 10.9 |
| 3. | Mylar/Aluminum Composite | 25 | 17.7 |
| 4. | Mylar/Aluminum Composite | 12.7 | 8.8 |

The vacuum-metallized film for use in this invention is ideal where the operational range requires a very thin metal layer prepared by a process wherein the metal is heated in a high vacuum to a vapor which then condenses on a moving web of film usually polyester (e.g., Mylar or Kapton) in a thin flexible layer. A commercial supplier of the described composite film of a metal layer on polyester film is Scharr Industries of Bloomfield, Conn. and Atlanta, Ga.

I claim:

1. A composite window having a low electron cross-section and improved electron transmission characteristics for use with high-power, high energy electron-beam guns wherein the environment of use includes a high vacuum on the electron beam entrance side of the composite window and a high pressure on the electron beam exit side of the composite window, said composite window comprising:

(i) a first material of a polyester film for supporting a low-Z metal layer, said polyester film having a low-Z of about 4.5 and a higher-strength than the low-Z metal layer;

(ii) a second material in the form of a layer of a low-Z metal in intimate contact with said polyester film, said low-Z metal layer being an aluminum layer in the form of a foil which is laminated with said polyester film, or an aluminum layer which is vapor deposited on said polyester film, said low-Z metal layer having good heat transfer characteristics for removing energy deposited in the low-Z metal layer due to the electron beam which first penetrates the low-Z metal layer on the beam entrance side of said composite window, said composite laminated window having a thickness of up to about 1 mil.; and, (iii) a plurality of fluid cooled, spaced apart foil support members for supporting and cooling said composite window, said support members being spaced apart about 0.1 inch, said composite window having an improved electron transmission at 100 keV that rises from about 62 percent when measured on the exit side of a 2 mil thick aluminum window to about 85 percent when measured on the exit side of said composite window.

* * * * *